United States Patent [19]

Takahashi et al.

[11] 4,370,588

[45] Jan. 25, 1983

[54] CATHODE ASSEMBLY

[75] Inventors: Kenji Takahashi, Hyogo; Yukio Takanashi, Hiratsuka, both of Japan

[73] Assignee: Tokyo Shibaura Denki Kabushiki Kaisha, Kawasaki, Japan

[21] Appl. No.: 161,569

[22] Filed: Jun. 20, 1980

[30] Foreign Application Priority Data

Jun. 21, 1979 [JP] Japan ..... 54-77522

[51] Int. Cl.[3] ..... H01J 1/94; H01J 19/48

[52] U.S. Cl. ..... 313/270; 313/37; 313/45; 313/446

[58] Field of Search ..... 313/37, 38, 45, 445, 313/446, 451, 270, 46, 456

[56] References Cited

U.S. PATENT DOCUMENTS

| | | | |
|---|---|---|---|
| 2,914,694 | 11/1959 | Ning Chin | 313/446 X |
| 3,333,138 | 7/1967 | Szegho | 313/446 X |
| 3,351,792 | 11/1967 | Kuryla | 313/451 X |
| 3,385,997 | 5/1968 | Vitzthum | 313/38 X |
| 3,450,927 | 6/1969 | Schmidt et al. | 313/270 |
| 3,895,249 | 7/1975 | Andre et al. | 313/37 |
| 4,184,100 | 1/1980 | Takahashi et al. | 313/370 |
| 4,185,223 | 1/1980 | Anezaki | 313/446 |

FOREIGN PATENT DOCUMENTS

| | | | |
|---|---|---|---|
| 2415153 | 6/1975 | Fed. Rep. of Germany | 313/337 |
| 387275 | 2/1933 | United Kingdom | 313/337 |
| 1113748 | 5/1968 | United Kingdom | 313/270 |
| 1404473 | 8/1975 | United Kingdom | 313/346 |

*Primary Examiner*—Saxfield Chatmon, Jr.

*Attorney, Agent, or Firm*—Cushman, Darby & Cushman

[57] ABSTRACT

A cathode assembly for cathode-ray tube which comprises a cathode sleeve with a blackened surface, a first cylindrical reflective member fixedly put on the top end portion of the cathode sleeve with a fixing point therebetween and having one end portion closed up with a metal substrate, and a second cylindrical reflective member attached to the cathode sleeve by means of support members so as to be on the same axis with the cathode sleeve and having a diameter greater than that of the cathode sleeve, both the first and second cylindrical reflective members being provided for reflecting radiant heat from the cathode sleeve, and the length of the first cylindrical reflective member being set so that an angle formed between the longitudinal direction of the cathode sleeve and a straight line connecting a heat radiation peak point on the outer surface of the cathode sleeve and the inner edge of a top opening portion of the second cylindrical reflective member, on a plane passing through the same axis, may be 30° or less.

5 Claims, 7 Drawing Figures

CATHODE ASSEMBLY

This invention relates to a cathode assembly used for the electron gun of cathode-ray tube.

In cathode-ray tubes, such as e.g. color picture tubes, an electron gun uses a cathode assembly of quick heating type in order to reduce the time (image-on time) required for the appearance of an image on the phosphor screen after the electric source is connected.

FIG. 1 shows a prior art example of such quick heating type cathode assembly. In FIG. 1, a cathode sleeve 12 formed of nickel-chromium alloy, which has a disk-like metal substrate 11 thrusted and fixed in the top end portion thereof, is fixed to a top end portion 14*a* of a cathode sleeve supporting cylinder 14 by means of three support members 13 which are fixed to the bottom end of the cathode sleeve 12 at intervals of 120° so that the cathode sleeve 12 may be on the same axis with the cylinder 14. The cathode sleeve 12, having the metal substrate 11 and the support members 13 fixed respectively to its top and bottom ends, is heated for blackening at a temperature of 1,000° C. for 30 minutes in hydrogen atmosphere containing water with a dew point of 20° C. before it is attached to the cathode sleeve supporting cylinder 14.

When using the cathode assembly of such construction for the electron gun of a color picture tube, the heater power is e.g. 1.26 W for each cathode assembly, and the image-on time is approximately 4 seconds. Recently have been used energy-saving color picture tubes with a narrow neck diameter to save deflection power. These color picture tubes require a cathode assembly having a heater of small power consumption in order to prevent excessive increase of the temperature around the cathode assembly. In this case, however, the image-on time will be prolonged if the heater power of the cathode assembly is simply reduced. Moreover, the temperature of the metal substrate 11, as well as of electron emissive coating thereon, will be lowered to reduce emission of electrons, thereby prohibiting normal operation of the cathode assembly. Accordingly, it is essential to reduce the heater power while maintaining the temperature of the metal substrate and shortening the image-on time.

In general, the relationships between the image-on time, heater power, and the thermal capacitance of a cathode consisting of the cathode sleeve 12 and the metal substrate 11 may be given by $$t = K \cdot Cth/Ph.$$

Here t: image-on time,

Cth: thermal capacitance,

Ph: heater power,

K: constant.

As may be seen from this equation, the image-on time and heater power may be reduced by decreasing the thermal capacitance of the cathode or by effectively utilizing heat from the heater. The thermal capacitance of the cathode can be decreased by reducing the cathode in size, that is, by reducing the outside diameter and wall thickness of the metal substrate 11 and the cathode sleeve 12. Meanwhile, the key to the effective use of the heat from the heater is to catch radiation energy from the heater efficiently. In the cathode assembly shown in FIG. 1, for example, radiation from an open end portion 15 of the cathode sleeve 12 can be prevented by making the cathode sleeve 12 longer than the heater. Further, radiant heat from the heater may effectively be absorbed by blackening the inner surface of the cathode sleeve 12.

In order to maintain the temperature of the metal substrate 11 at the desired working temperature with use of low heater power, moreover, it is necessary only that the cathode assembly be reduced in size to decrease radiation area and hence to reduce radiation from the outer surface of the cathode sleeve 12.

The inner surface of the cathode sleeve 12 may be blackened by subjecting only the inner side of a cathode sleeve, which is formed of a laminated metal plate having nickel-chromium alloy on the inside and nickel on the outside, to an oxidizing treatment in hydrogen atmosphere containing water with a dew point of 20° C. With the cathode sleeve formed of such laminated metal plate, however, chromium will be diffused into nickel to reach the outer surface of the cathode sleeve 12 during the operation of the cathode, so that the emissibility of the outer surface of the cathode sleeve 12 will be increased to lower the temperature of the cathode sleeve 12, thereby decreasing the temperature of the metal substrate 11.

If the cathode sleeve 12 is formed of nickel-chrominum alloy, moreover, chromium contained in the nickel-chromium alloy will be diffused into the metal substrate 11 in contact with the cathode sleeve 12 during the operation of the cathode, and will react on electron emissive material to shorten its life. Since the diffusion of chromium may reach a distance of 0.2 mm to 0.3 mm from the peripheral portion of the metal substrate 11, so that the outside diameter of the metal substrate 11 need be 0.4 to 0.6 mm greater than the practical diameter required, constituting an obstacle to the miniaturization of the cathode assembly.

The object of this invention is to provide a cathode assembly capable of quick heating with low heater power in spite of its simple structure.

According to this invention, there is provided a cathode assembly for cathode-ray tube comprising a cathode sleeve with a blackened surface, a first cylindrical reflective member fixedly put on the top end portion of the cathode sleeve with a fixing point therebetween and having one end portion closed up with a metal substrate, and a second cylindrical reflective member attached to the cathode sleeve by means of support members so as to be on the same axis with the cathode sleeve and having a diameter greater than that of the cathode sleeve, both the first and second cylindrical reflective members being provided for reflecting radiant heat from the cathode sleeve, and the length of the first cylindrical reflective member being set so that an angle formed between the longitudinal direction of the cathode sleeve and a straight line connecting a heat radiation peak point on the outer surface of the cathode sleeve and the inner edge of a top opening portion of the second cylindrical reflective member, on a plane passing through the same axis, may be 30° or less.

This invention can be more fully understood from the following detailed description when taken on conjunction with the accompanying drawings, in which:

FIG. 2A is a sectional view of the cathode assembly of FIG. 1 having a heater built-in;

FIG. 4A is a sectional view of the cathode assembly of FIG. 3 having a heater buil-in;

Figure 1:
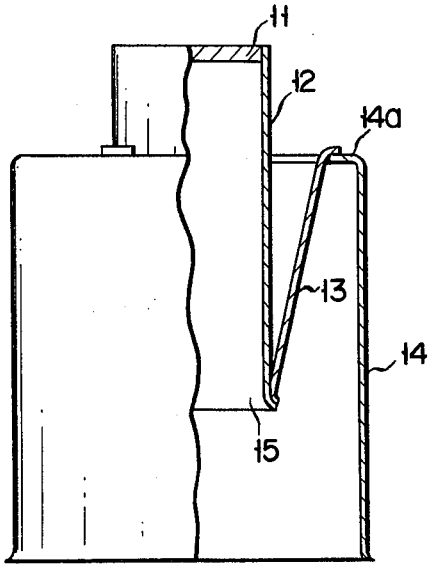
FIG. 1 PRIOR ART
FIG. 1 is a sectional view of a prior art cathode assembly.
Figure 2A:
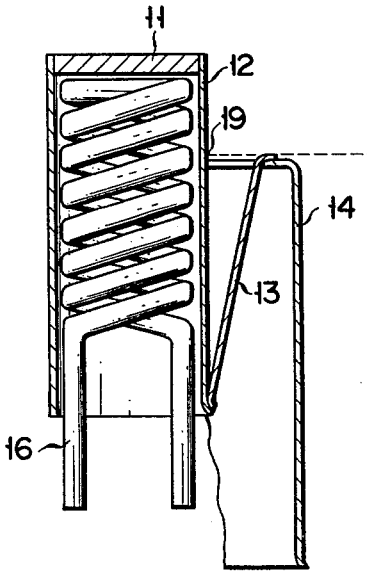
FIG. 2A PRIOR ART
Figure 2B:
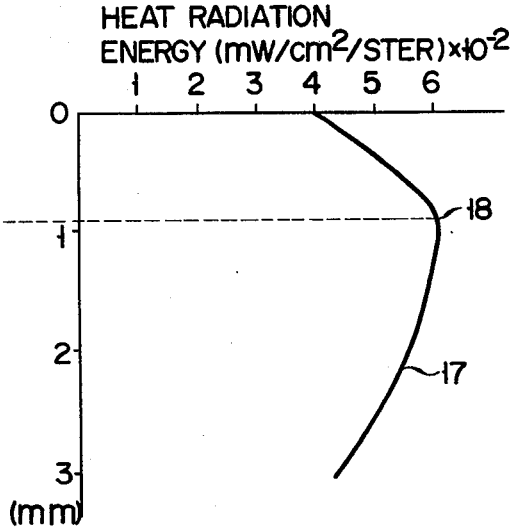
FIG. 2B is a graph showing the distribution of heat radiation energy corresponding to FIG. 2A.

Generally, in a cathode sleeve of a cathode assembly, there exists a spot which is sure to display the maximum value of heat radiation energy owing to the state of heat radiation from a heater, heat conduction loss, heat reflection from the environment, emissibility difference, etc. This spot is a heat radiation peak point. Accordingly, there will now be described the way of finding the position of the heat radiation peak point which is essential to the explanation of the cathode assembly of this invention. Taking the prior art cathode assembly shown in FIG. 1 as an example, a heater 16 is set in the cathode sleeve 12, and a slit for temperature measurement is formed in the cathode sleeve supporting cylinder 14. When the radiation energy on the surface of the cathode sleeve 12 is measured through the slit by using a radiation pyrometer after letting current flow through the heater 16, there is obtained a curve 17 as shown in FIG. 2B. A point 19 of the cathode sleeve 12 in FIG. 2A corresponding to the maximum value 18 of the curve 17 is the very heat radiation peak point.

Referring now to the drawing of FIG. 3, there will be described a first embodiment of the cathode assembly of this invention.

Figure 3:
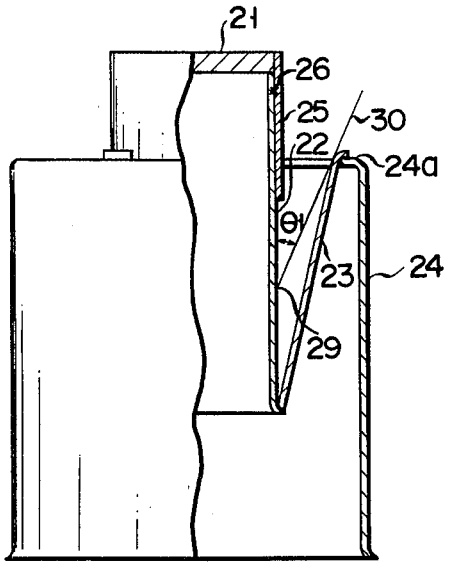
FIG. 3 is a sectional view of a cathode assembly according to an embodiment of this invention.

In FIG. 3, a first cylindrical reflective member 25, which has a disklike metal substrate 21 thrusted and fixed in the top opening portion thereof, surrounds the upper portion of a cathode sleeve 22. The cathode sleeve 22 and the member 25 are fixed to each other at a fixing point 26 by welding or the like. The cathode sleeve 22 is fixed to an opening periphery **24*a* at the top end of a second cylindrical reflective member 24 by means of three support members 23 which are fixed to the bottom end of the cathode sleeve 22 at intervals of 120° by welding so that the cathode sleeve 22 may be on the same axis with the member 24. The cathode sleeve 22, having the support members 23 fixed to its bottom end, is heated for blackening at a temperature of 1,000° C. for 30 minutes in hydrogen atmosphere containing water with a dew point of 20° C. before it is attached to the second cylindrical reflective member 24. Namely, the surface of the cathode sleeve 22** is covered with chromium oxide.

Thus, by disposing the first cylindrical reflective member 25 around the top portion of the cathode sleeve 22, heat from the cathode sleeve 22 is reflected by the reflective member 25 to reduce heat radiation to the outside. The existence of the first cylindrical reflective member 25 theoretically increases thermal capacity, acting against the reduction of the image-on time. Unlike other components of the cathode assembly, however, the first cylindrical reflective member 25 can be thinned without taking account of mechanical strength and thermal shock resistance, so that the thermal capacitance will not practically be increased.

Generally, as described above, the cathode sleeve is made of nickel-chromium alloy, and has blackened outer surface with chromium oxide formed thereon. Heat radiation from the blackened surface of the cathode sleeve is equivalent to heat radiation from the surface of a non-conductive material. The strength of heat radiation from the surface of the non-conductive material is substantially uniform with radiation at an angle exceeding 30° to the radiation surface, but decreases drastically below 30°. This phenomenon is stated in E. Schimdt and E. Eckert: Forsch Gebiete Ingenieur W., 6, 175 (1935). In the cathode assembly of this invention, the first and second cylindrical reflective members 25 and 24 are arranged by taking advantage of such phenomenon. Namely, the first and second cylindrical reflective members 25 and 24 are so formed and arranged that an angle formed between the longitudinal direction of the cathode sleeve 22 and a straight line connecting the heat radiation peak point 29 of the cathode sleeve 22 and the top opening edge **24*a* of the second cylindrical reflective member 24, on a plane passing through the axis of the cathode sleeve 22, may be 30° or less. Normally, the position of the heat radiation peak point 29 is so controlled as to be in accord with the aforesaid relationship by adjusting the length of the first cylindrical reflective member 25. By doing this, most of heat radiated from the cathode sleeve 22, especially from the vicinity of the heat radiation peak point 29 is reflected by the inner surface of the second cylindrical reflective member 24**, and is not radiated to the outside, so that a power-saving cathode assembly can be obtained.

With the prior art cathode assembly with the cathode sleeve formed of nickel-chromium alloy, as mentioned before, the diameter of the metal substrate must be excessively great for the diffusion of chromium contained in the cathode sleeve into the metal substrate. In the cathode assembly of this invention, however, the metal substrate 11 is thrusted and fixed in the opening portion of the first cylindrical reflective member 25, and the first cylindrical reflective member 25 can be formed of any material which is poor in mechanical strength and/or thermal shock resistance, allowing free selection of material. Thus, the member 25 may be formed of a material containing none or Cr, Cu, Fe and Mn that are harmful to electron emissive material, so that the metal substrate 21 need not be increased in diameter. Preferred materials for the first cylindrical reflective member 25 are Ni alloys containing reducing materials, such as Mg, Si, Al, Zr, etc., and/or crystallization inhibitors such as W, Co, etc. The crystallization inhibitors are used because if the material forming the first cylindrical reflective member 25 causes crystal grains to grow, the thermal conductivity will be deteriorated to increase the temperature of the cathode.

In the cathode assembly of this invention, the growth of crystal grains can be caused within a region of the first cylindrical reflective member 25 between the periperal edge portion of the metal substrate 21 and the fixing point 26. Therefore, the region of the first cylindrical reflective member 25 to cause the growth of crystal grains can be reduced by bringing the fixing point 26 as close to the metal substrate 21 as possible, e.g., by locating the fixing point 25 at a position nearer to the metal substrate 21 than the middle point of the length of the first cylindrical reflective member 25 is or at a position within 1.0 mm from the under surface of the peripheral edge portion of the metal substrate 21. Thus, the emissibility and thermal conductivity will hardly be changed, so that the cathode will be able to enjoy further prolonged life without involving any temperature change in the metal substrate 21. In the cathode assembly of this invention, moreover, the first cylindrical reflective member 25, which functions to retain the metal substrate 21 and to reflect heat from the cathode sleeve 22, never forms a heat path and hence serves as a heat dam, so that it will not cause any increase in temperature even if a growth of crystal grains is seen.

Now there will be described a more specific example of the cathode assembly according to the above-mentioned first embodiment of this invention.

In the cathode assembly shown in FIG. 3, the first cylindrical reflective member 25 is a hollow cylindrical body formed of nickel alloy containing 4% of tungsten and having an outside diameter of 1.4 mm, wall thickness of 20μ, and length of 1.5 mm. The disklike metal substrate 21 with a thickness of 0.15 mm was fitted and fixed into one opening portion of the member 25. Then, the cathode sleeve 22 formed of nickel-chromium alloy and having an outside diameter of 1.32 mm, wall thickness of 20μ, and length of 3.0 mm was inserted deep into the first cylindrical reflective member 25 through the other opening portion thereof until it was in the vicinity of the metal substrate 21, and was fixed at the fixing point 26. Thereafter, the three support members 23 were fixed to the bottom end portion of the cathode sleeve 22 at intervals of 120°. Then, the cathode sleeve 22 was heated for blackening in hydrogen atmosphere with a dew point of 20° C., at a temperature of 1,000° C. for 30 minutes. Containing no Cr, the support member 23 and the first cylindrical reflective member 25 were not blackened. Thereafter, the cathode sleeve structure constructed in the aforesaid manner was inserted into the second cylindrical reflective member 24 with the top opening diameter of 2.5 mm so that both these structures might be on the same axis. Further, the open end portions of the support members 23 were bent at such a position that the distance between a plane including the top face of the metal substrate 21 and the top opening end portion 24*a* of the second cylindrical reflective member 24 is 0.83 mm, and were fixed to the top opening end portion 24*a* of the second cylindrical reflective member 24.

Figure 4A:
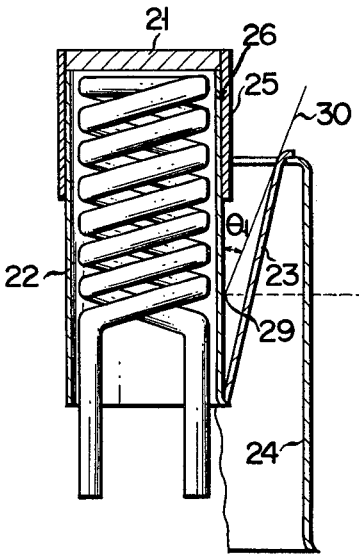
Figure 4B:
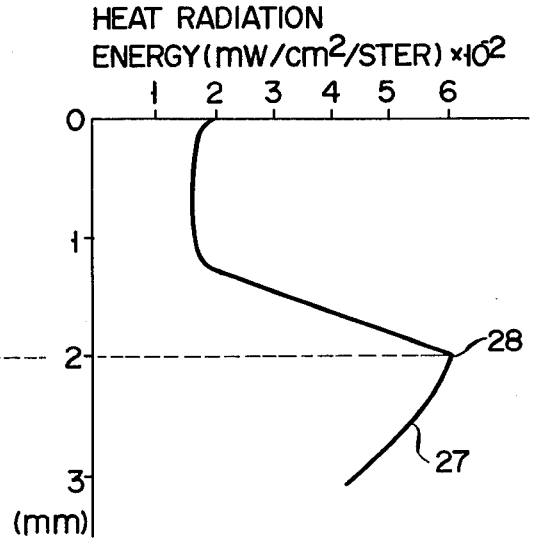
FIG. 4B is a graph showing the distribution of heat radiation energy corresponding to FIG. 4A.

After a heater 20 was set in the cathode sleeve 22 of the cathode assembly constructed in this manner, as shown in FIG. 4A, the heater 20 was energized. When heat radiation energy from the cathode sleeve 22 and the first cylindrical reflective member 25 at such energizing was measured through a slit formed on the second cylindrical reflective member 24 by using a radiation pyrometer, there was obtained a curve 27 as shown in FIG. 4B. The axis of ordinate of the graph of FIG. 4B represents the distance from the top face of the metal substrate 21, corresponding to the cathode assembly shown in FIG. 4A. As shown in FIG. 4B, the heat radiation peak point of the cathode sleeve 22 was found to be located at a position 29 corresponding to the maximum value 28 of the curve 27, that is, a position 2.0 mm apart from the top face of the metal substrate 21. Further, an angle $\theta_1$ formed between the longitudinal direction of the cathode sleeve 22 and a straight line 30 connecting the heat radiation peak point 29 and the top opening edge 24*a* of the second cylindrical reflective member 24, on a plane including the axis of the cathode sleeve 22, was 27°. Surpassing the prior art cathode assembly of the same size, as shown in FIG. 1, by approximately 20% in thermal efficiency and capable of miniaturization as aforesaid, the cathode assembly of this embodiment was able to be operated with a heater power of 0.63 W—half of the heater power of 1.26 W applied to the prior art cathode assembly. When operated with such heater power, moreover, the cathode assembly of this embodiment displayed substantially the same characteristics; image-on time of 4 second and cathode temperature of 1,070 K.

Referring now to the drawing of FIG. 5, there will be described a cathode assembly according to a second embodiment of this invention.

Figure 5:
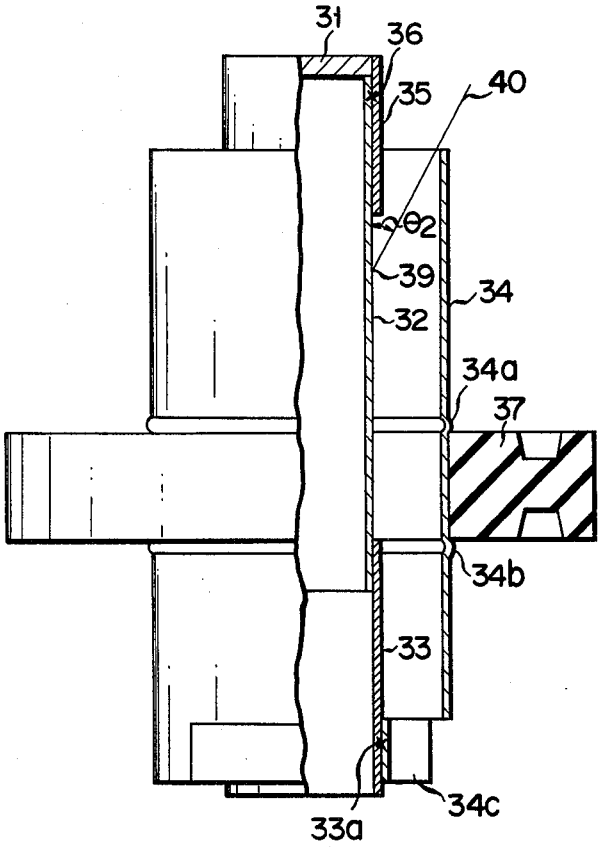
FIG. 5 is a sectional view of a cathode assembly according to another embodiment of the invention.

In FIG. 5, a first cylindrical reflective member 35, which has a disklike metal substrate 31 of 0.15 mm thickness thrusted and fixed in the top opening portion thereof, was so set as to surround the upper portion of a cathode sleeve 32, and was fixed at a welding point 36. The first cylindrical reflective member 35 is a hollow cylindrical body formed of nickel alloy containing 4% of tungsten and having an outside diameter of 1.4 mm, wall thickness of 20μ, and length of 1.5 mm, while the cathode sleeve 32 is a cylindrical body formed of nickel-chromium alloy and having an outside diameter of 1.32 mm, wall thickness of 20μ, and length of 6.0 mm. A support member 33 was attached to the bottom end of the cathode sleeve 32 by welding. The cathode sleeve 32, along with the first cylindrical reflective member 35 and the support member 33 attached thereto, was heated in hydrogen atmosphere with a dew point of 20° C. for approximately 30 minutes, and only the cathode sleeve 32 was blackened.

A second cylindrical reflective member 34, on which two projected portions 34*a* and 34*b* are formed at a given space from each other, were attached to a substrate 37 formed of ceramic, etc. by means of the projected portions 34*a* and 34*b*. The bottom end portion of the second cylindrical reflective member 34 is partially notched and inwardly bent to form a bent portion 34*c*. By welding the bent portion 34*c* to the support member 33 attached to the bottom end of the cathode sleeve 32 at a welding point 33*a*, the cathode sleeve 32 was fitted in the second cylindrical reflective member 34 so as to be on the same axis therewith. This fitting was done in such a manner that the distance between a plane including the top face of the metal substrate 31 and the top end portion of the second cylindrical reflective member 34 is 0.83 mm.

In the cathode assembly constructed in the aforementioned manner, an angle $\theta_2$ formed between the longitudinal direction of the cathode sleeve 32 and a straight line 40 connecting a heat radiation peak point 39 and the top end portion of the second cylindrical reflective member 34, on a plane passing through the axis of the cathode sleeve 32, was 17°. When a heater power of 0.45 W was applied to the cathode assembly, the image-on time was 4 seconds, and the temperature of the metal substrate 31 was 1,070 K. In this case, the heat radiation peak point 39 can be shifted upward by shortening the first cylindrical reflective member 35 because the angle $\theta_2$ is considerably narrow. Thus, the thermal capacitance and hence the image-on time can be further reduced.

According to the cathode assembly of this invention, as described herein with reference to the two embodiments, the heater power can be reduced by a large margin, which will be of great industrial value.

What we claim is:

1. A cathode assembly for cathode-ray tube comprising:

a cathode sleeve having a blackened surface;

a first cylindrical reflective member having an unblackened surface fixedly positioned about a top end portion of said cathode sleeve with a fixing point therebetween and having one end portion thereof closed by a metal member; and a second cylindrical reflective member positioned about said cathode sleeve on the same axis therewith and having a diameter greater than that of said cathode sleeve, support member means for fixing the position of said second cylindrical reflective member with respect to said cathode sleeve, both said first and second cylindrical reflective members providing means for reflecting radiant heat from said cathode sleeve, said second cylindrical reflective member having an upper portion that is apart from and overlapping in vertical position a lower portion of said first cylindrical reflective member, and the length of said first cylindrical reflective member being selected such that an angle formed between the longitudinal direction of said cathode sleeve and a straight line connecting a heat radiation peak point on the outer surface of said cathode sleeve and an inner edge of a top opening portion of said second cylindrical reflective member, on a plane passing through said same axis, is 30° or less.

2. A cathode assembly according to claim 1, wherein the fixing point between said first cylindrical reflective member and said cathode sleeve is located within 1.0 mm from the top face of said metal substrate.

3. A cathode assembly according to claim 1, wherein said first cylindrical reflective member is formed of Ni alloy containing at least one kind of material selected among a group of materials including reducing material(s) and crystallization inhibitor(s).

4. A cathode assembly according to claim 3, wherein said reducing material or materials are at least one material selected among a group including Mg, Si, Al and Zr, and said crystallization inhibitor or inhibitors are at least one material selected among a group including W and Co.

5. A cathode assembly according to claim 3, wherein said reducing material or materials are other material(s) than Cr, Cu, Fe and Mn.

* * * * *